United States Patent [19]

Vreede

[11] 4,171,753

[45] Oct. 23, 1979

[54] HOLDER FOR CAPSULES, PILLS AND SIMILAR OBJECTS

[76] Inventor: Bastiaan Vreede, Catsheuvel 107, The Hague, Netherlands

[21] Appl. No.: 876,502

[22] Filed: Feb. 9, 1978

Related U.S. Application Data

[63] Continuation-in-part of Ser. No. 749,351, Dec. 10, 1976, abandoned.

[51] Int. Cl.[2] ..... B65H 1/00; B65H 1/08; G07F 11/16; B65D 83/04

[52] U.S. Cl. ..... 221/197; 206/536; 221/198; 221/229; 221/247

[58] Field of Search ..... 206/537, 535, 536, 528, 206/306; 221/229, 230, 231, 232, 246, 247, 197, 198

[56] References Cited

U.S. PATENT DOCUMENTS

| | | | |
|---|---|---|---|
| 1,475,567 | 11/1923 | Dall | 229/11 |
| 1,485,716 | 4/1924 | Rogers | 206/535 |
| 2,620,061 | 12/1952 | Uxa | 221/229 |
| 3,410,455 | 11/1968 | Haas | 221/229 |
| 3,511,409 | 5/1970 | Huck | 221/231 |
| 3,918,920 | 11/1975 | Barber | 206/306 |

FOREIGN PATENT DOCUMENTS

| | | | |
|---|---|---|---|
| 1032597 | 4/1953 | France | 221/232 |

*Primary Examiner*—William T. Dixson, Jr.
*Attorney, Agent, or Firm*—Leydig, Voit, Osann, Mayer & Hold, Ltd.

[57] ABSTRACT

A holder for pills, capsules and similar uniformly shaped objects for dispensing said objects one by one. A hollow inner tube has an open bottom for receiving the objects and a closed top for limiting axial movement thereof. A hollow outer tube has a spring affixed to a closed bottom and receives the inner tube, the spring biasing the objects upwardly. A dispensing mechanism in a cylindrical casing is affixed to the upper end of the outer tube. The dispensing mechanism operates through diametrically opposed slots in the periphery of the inner tube to dispense the objects one by one. The unit is arranged so that with minor modification a variety of sizes and shapes of objects can be dispensed.

10 Claims, 10 Drawing Figures

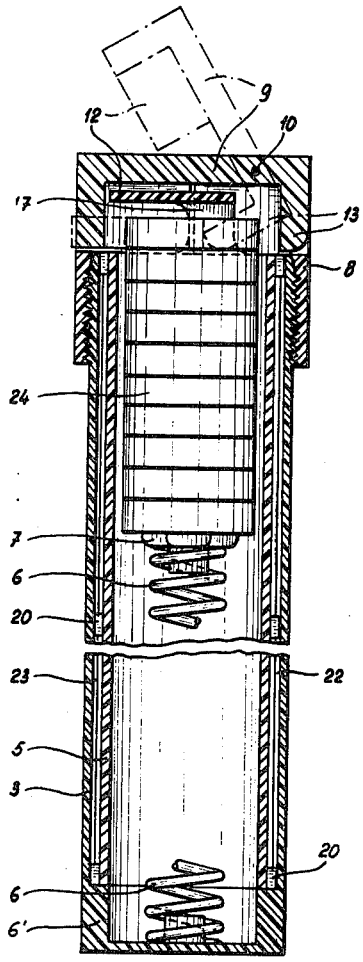

HOLDER FOR CAPSULES, PILLS AND SIMILAR OBJECTS

This is a continuation-in-part of my copending application Ser. No. 749,351, filed Dec. 10, 1976 now abandoned.

This invention concerns a holder for pills, capsules and similar uniformly shaped objects, equipped with mechanism to dispense the objects in the holder one by one.

From amongst others, the Dutch patent applications Nos. 74.04778 and 75.07574, are known devices that dispense pills one by one. These are equipped with a mechanism to conduct each time one single pill from a quantity of pills contained in the holder to a dispenser opening in the holder and to eject such a pill from the holder. The mechanisms that are used for this purpose are quite complicated in their construction and the operation also requires a certain adoitness from the user. In addition these known devices are usually limited as far as their use is concerned, to pills with a predetermined shape and size.

The main object of the invention is to provide an instrument that is very simple to operate, relatively simple in construction, and can be used for or adapted to pills and similar objects having various shapes and sizes. In addition this instrument can be easily carried around by its owner and will aid him in taking his medication as prescribed.

Accordingly, the present invention provides a hollow outer tube closed at one end and open at the other and a dispensing mechanism having means for securing same to the outer tube over the open end thereof. The outer tube has a spring attached to the closed end which, in the relaxed condition, extends to the open end. A hollow inner tube is insertable into the outer tube and has a length which extends over the greater part of the length of the outer tube. The inner tube has means for conforming the inner diameter thereof to the shape of the objects so that a stack of such objects is held within the inner tube. The inner tube is open at one end for receiving the spring and biasing the objects, and closed at the other end for limiting axial travel of the objects. In addition, the inner tube is slotted at diametrically opposite sides of its periphery for allowing entry of a pusher and allowing exit of the objects. The dispensing mechanism has manually operable means connected to said pusher for displacing said pusher portion in a radial direction to dispense the objects one by one.

In the instrument according to the invention, the inner tube functions as a holder for the pills or capsules or similar objects which are to be ejected and this inner tube can be fitted into the outer tube from the top after having been filled previously. Under influence of the spring in the outer tube the pills are being pushed upwards in such a manner that the uppermost pill in the inner tube can be ejected by operation of the ejector mechanism which is fastened to the top of the outer tube.

The instrument is readily adjustable to the size and shape of pills because the inner tube is removable from the outer tube so that if a user; after having used the instrument for one type of pill, wants to use it for pills of different shapes and sizes, he can use a different inner tube which is adjusted to this different shape and size, without changing the outer tube. Each individual inner tube, however, can accommodate several different shapes of pills and capsules.

According to the invention, an efficient and readily operable embodiment of construction is obtained in that the dispensing mechanism comprises a cylindrical casing having means for fixing same to the outer tube, an ejector opening in the periphery of the casing, and a slider arranged for radial travel in said casing between open and closed positions. Closure means are connected to the slider for opening and closing the ejector opening in the associated slider positions. In addition, means are provided for connecting the pusher to the slider for ejecting the uppermost one of the objects through the ejector opening as said slider is manually moved from the closed to the open position.

In an alternative dispensing mechanism, a cylindrical casing with ejector opening has a lever pivotable on a pivot in the casing and means at one end of the lever for closing the ejector opening in one lever position and opening same in the other lever position. The pusher is located at the opposite end of the lever, whereby manually pivoting the lever opens the ejector opening and radially displaces the pusher to push the uppermost one of the objects through the ejector opening.

The pivotable lever is biased, into its closed position, preferably by means of a spring acting on the pivot; it is preferable to make the spring powerful enough so that the mechanism cannot be operated by a small child. To eject the pill from the instrument, one only needs to press the lever with a finger or thumb in the same way as is done, for example, with a cigarette lighter.

To be able to refill the instrument after it has been emptied, the dispensing mechanism is housed in a cylindrical casing having means for securing same to the outer tube at the open end thereof, for example by complementary screw threads or a bayonet mechanism. With such a mechanism, known methods can be used to ensure that when the upper tube part is secured, the ejector arm and the ejector opening will be aligned with the openings in the top end of the inner tube.

When desired, the instrument can be equipped with means to check up on the number of dispensed objects, said means consisting of an automatic, adjustable counter mechanism cooperating with the ejector mechanism. As an alternative, a check-off strip can be affixed on the outer tube, to be filled in by hand, on which the days of the week and the number of pills to be taken per day are stated, to be crossed off each time a pill is taken. Especially in case this instrument is used for taking pills and other similarly shaped medical products which have to be taken in prescribed doses, such measuring mechanisms as part of the instrument according to the invention are very useful.

To guide the pills in the right position in the inner tube, the inner shape and size of the inner tube is conformed to the shape and size of the pills that are to be used. To this end, the inner tube can be provided with a number of ribs which are spaced apart a certain distance along the inner circumference of the inner wall, and which protrude radially inwards while extending over the total length of the inner tube. To make the instrument useful for objects of different shapes and sizes, various inner tubes can be delivered with the same outer tube in which the inner shapes and sizes of these inner tubes differ from each other and are adjusted to the various shapes and sizes of the various objects. These differences in inner shapes of the inner tubes can be obtained by having the guiding ribs protrude further or less far into the tube.

For facilitating filling of the inner tube with pills, the inner tubes are preferably composed of two removably connected half cylindrically shaped parts. To this end the half cylindrical shaped parts may be hingedly interconnected at one side and have snap fasteners at the other side. As an alternative both sides of the half cylindrical parts can be provided with snap fasteners.

To be able to bring the inner tube into the right position in relation to the outer tuber, both inner and outer tube can be equipped with cooperating members which, according to a practical embodiment, may be obtained by having the fasteners of the half cylindrical inner tube parts protrude slightly from the inner tube and by having longitudinal grooves provided along the inner wall of the outer tube, into which the fasteners of the inner tube parts can slide during placement of the inner tube. It goes without saying that other commonly known methods can be used to keep the inner tube in the right position in relation to the outer tube, e.g., guide channels placed in the removable upper part of the outer tube to accept protruding wings on the closed top end of the inner tube, so that, when the top of the outer tube is screwed into place, the openings in both inner and outer tubes will be kept in constant alignment.

To obtain an even distribution of the pressure against the column of pills by the spring in the outer tube, this spring is preferably equipped with a pressure platform at the top, the shape of which is adjusted to the inner shape of the inner tube.

In the following the invention will be explained in greater detail in connection with exemplary embodiments thereof and with reference to the drawings, in which:

FIG. 1 shows a view of a first embodiment of a pill holder 1 according to the invention which, in the illustrated embodiment, has a narrow cylindrical shape and can be clipped in the inner pocket of a jacket by means of a clip 2, in a similar way as for example a fountain pen.

Figure 1:
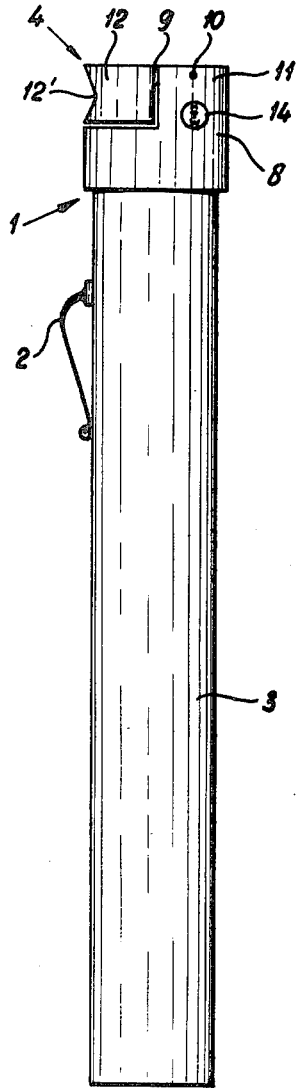
FIG. 1 is an elevation of one embodiment of the instrument according to the invention.

The illustrated pill holder consists of an outer tube 3, with an affixed ejector mechanism 4 and an inner tube 5.

The outer tube 3 is closed at the bottom and contains a pressure spring 6, which at its one end makes contact with the closed bottom of the tube 3 and which in its relaxed state extends to the top of tube 3. At its top the spring 6 is equipped with a platform 7, the function of which will be described in greater detail below. In addition, a shoulder 6' is present on the inner circumference at the bottom of tube 3.

Figure 2:
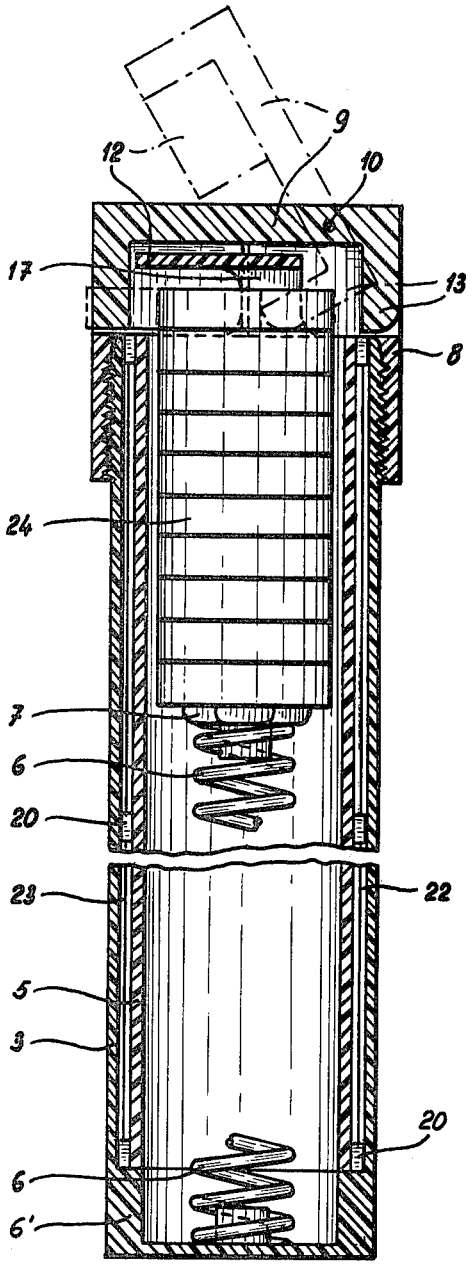
FIG. 2 is a longitudinal cross-section of the instrument according to FIG. 1, showing an outer and an inner tube filled with pills or similar objects.
Figure 3:
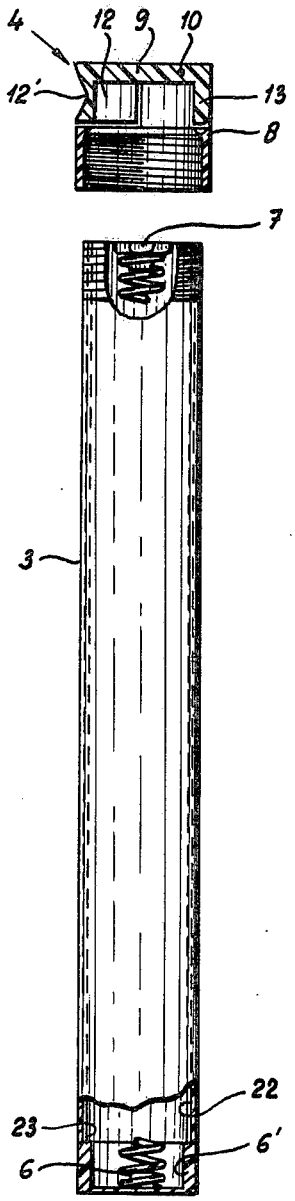
FIG. 3 is a longitudinal section of the outer tube in which the dispensing mechanism has been removed.
Figure 4:
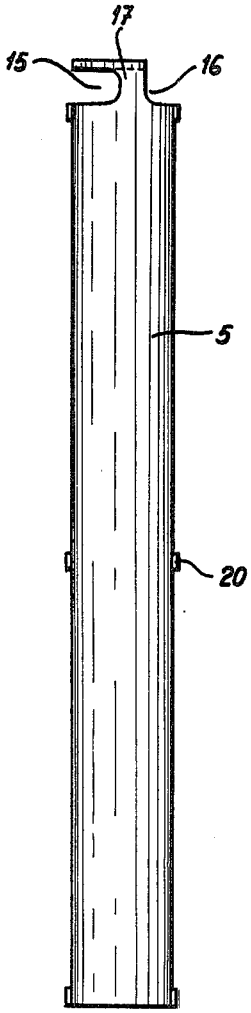
FIG. 4 is an elevation of the inner tube as used in the instrument according to FIGS. 1 and 2.

As can be seen in FIGS. 1 and 2, the tube 3 is equipped at the top with a screw-on top 8 in the form of a cylindrical casing which contains the ejector mechanism 4. The ejector mechanism 4 consists of a lever 9 which can pivot upon a horizontal pivot 10, which is biased by means of a spring in such a manner that the lever is biased to its horizontal position. The horizontal pivot 10 is positioned through the two cheeks 11 of the tube part 8. The lever has at one end a part 12 which in the horizontal position of the lever covers the opening in the tube part 8 on the ejector side of the cheeks 11. At the diametrically opposite end the lever is equipped with an ejector arm 13 which, when the lever is pivoted upon the horizontal pivot 10 towards the position indicated in FIG. 2 with the dot-dash lines, is moved towards the longitudinal axis of the tube part 8 through an opening in tube part 8 located between the two cheeks 11. In addition, a counter mechanism 14 can be placed within the cheeks 11 or elsewhere, which is triggered into action by every ejection movement of the lever 9. The counting mechanism can consist of a part positioned in one cheek 11 to count the days and on which the days of the week are registered as well as to count the number of pills that are being dispensed, and which can be adjusted for the number of pills to be taken per day. Alternatively, the counting mechanism can consist of a day counter in the one cheek and a digital pill counter in the other cheek, or an electronic display system for both. Whatever mechanism is used, each ejection movement of the lever 9 would turn this mechanism a certain distance. An exchangeable disc or an endless belt mechanism are two examples amongst others that could be employed. An endless belt, for example, could have different lines of symbols, each representing: number of pills to be taken per day for seven days. Each line of symbols could be color coded. By providing an adjustable window with magnifying lens so that only one symbol is visible at a time, the number of pills taken in a day would be clearly noted.

The inner tube 5 is open at the bottom end and at the top has diametrically opposite openings 15 and 16 which form respectively the ejector opening for the pills to be dispensed and the opening for the pusher 13. The remaining part 17 between the openings of the tube 5 is closed at the top.

Figure 5:
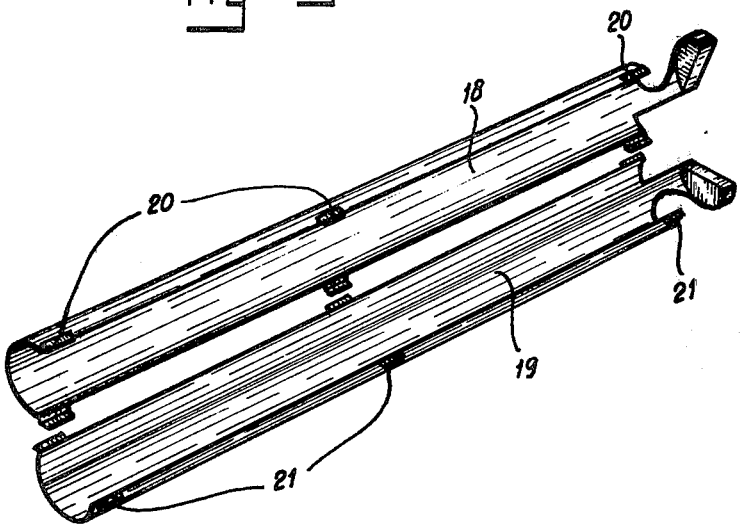
FIG. 5 is a perspective view of the half cylindrical parts which make up the inner tube.
Figure 6:
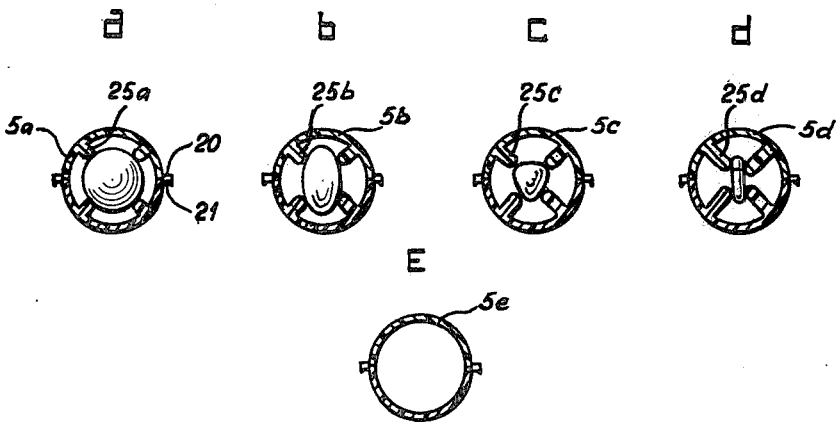
FIG. 6 illustrates schematic cross-sections of various inner tubes which can be used with the instrument according to the invention.
Figure 7:
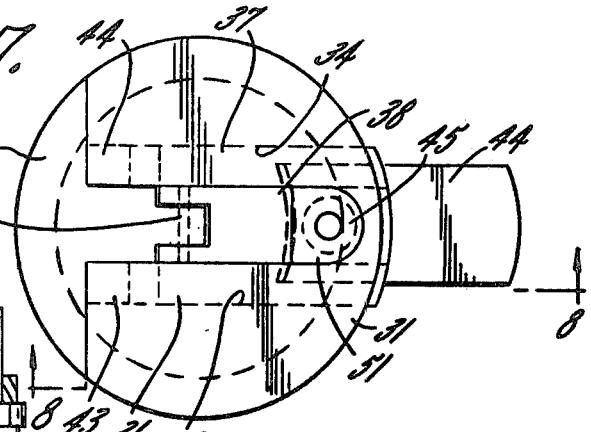
FIG. 7 is a plan view of a second embodiment of the dispensing mechanism.

The inner tube forms the actual pill holder. This tube is filled with pills or similar objects and then fitted into the outer tube 3 from the top in such a manner that the bottom end rests on the shoulder 6', after which the instrument is made ready for use in the manner described below. To simplify the filling of the inner tube, it can be assembled out of two removable half cylindrical parts 18 and 19 (see FIG. 5) which can be locked together by means of, for example, snap fasteners 20 and 21.

To fit tube 5, which has been filled with pills, into tube 3, the cylindrical cap 8 is removed from the outer tube. The inner tube 5 is fitted into the outer tube 3 in such a way that the openings 15 and 16 are aligned with respectively the opening in tube part 8 and the diametrically opposite opening for the ejector arm 13. To assure that this position is achieved, two diametrically opposite grooves 22 and 23 are made in the inner wall of the outer tube, in which, during the insertion of inner tube 5 the slightly protruding snap fasteners 20 and 21 are guided. In this way also turning of the inner tube in the outer tube during operation of the instrument is prevented.

During the insertion of the inner tube, the column of pills 24 contained therein is biased upwards by the spring 6 of the outer tube. Axial travel is limited by the closed top 17. To obtain a well distributed pressure on the column of pills 24, a platform 7 may be positioned on top of spring 6. When the inner tube 5 has been inserted into the outer tube, the cylindrical cap 8 housing the ejector mechanism 4 is screwed onto the outer tube, after which the instrument is ready for use.

When one desires to take a pill from the above described holder, one pushes lever 9 with its part 12 upwardly, for which purpose part 12 can be equipped with an indentation 12', which causes the lever to pivot to the position indicated in FIG. 2 by the dot-dash lines. During this pivoting of the lever, the uppermost pill of the column of pills is pushed out by the ejector arm 13 through the opening 15 of the inner tube 5 and the similar opening in the cylindrical cap 8 which has opened because part 12 of the lever 9 has been turned upwardly. When releasing the lever 9 it is pushed back into the horizontal position by the spring loaded pivot 10.

Figure 8:
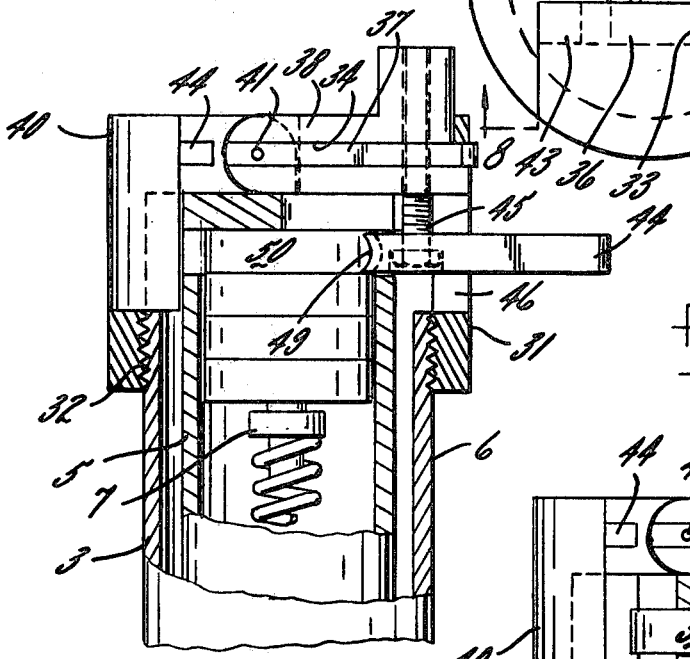
FIGS. 8, 9 and 10 are partial sectional views taken along the line 8—8 of FIG. 7 illustrating the dispensing mechanism of FIG. 7 in various operational positions.
Figure 9:
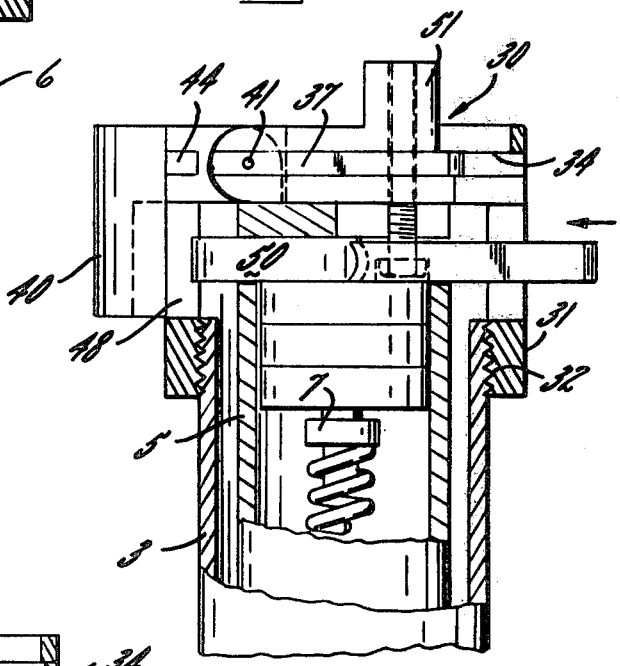
Figure 10:
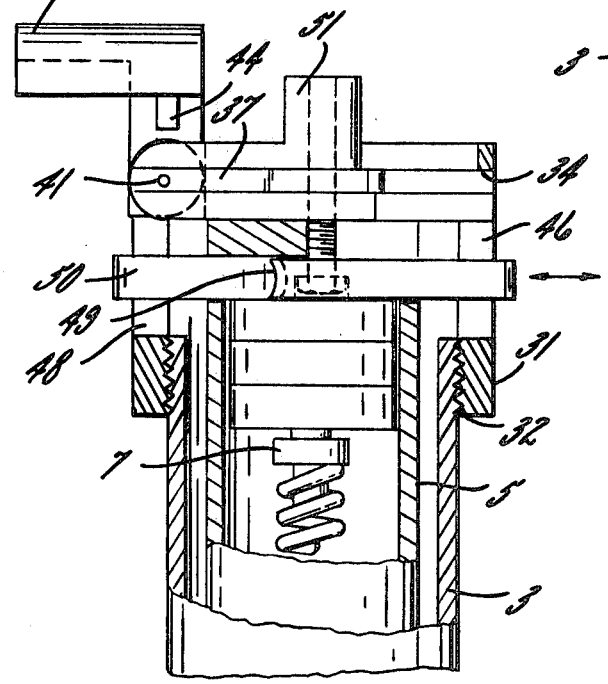

An alternative dispensing mechanism is illustrated in FIGS. 7–10. Because the inner and outer tubes remain substantially the same as those in the embodiment described above, the description of those elements will not be repeated. The dispensing mechanism generally indicated at 30, as in the previous embodiment, is carried in a cylindrical casing 31 having screw threads 32 mating complementary threads on the exterior of the outer tube 3. A pair of facing channels 33, 34 are formed in the casing to receive for slidable movement a pair of slides 36, 37 carried on a slider portion 38 of the ejector mechanism. As illustrated in the drawings, the slider portion 38 is movable between a rearward or closed position shown in FIG. 8 and a forward or open position shown in FIG. 10. A closure mechanism 40 is attached to the slider mechanism 38 by a spring-loaded pivot 41. The closure 40 also has a pair of slides 43, 44 which fit into the channels 33, 34 when the slider 38 is in the closed position (FIG. 8). However, when the slider is moved to the open position, the slides 43, 44 are moved fowardly of the tracks 33, 34 (FIG. 9) until ultimately the slides are moved free of the tracks and the spring-loaded pivot swings the closure 40 upwardly as shown in FIG. 10.

Cooperating with the slider 38 is a pusher mechanism including an radially movable pusher plate 44. Means are provided for adjustably securing the pusher plate 44 to the slider 38, such means being illustrated in the drawings as a screw 45. An enlarged opening 46 is provided in the rear of the cylindrical cap 31 to allow the pusher to project outside the cap when in the rear position and to allow sufficient axial adjustment to accommodate a number of different size pills, capsules, or the like. The cylindrical casing is also provided with an ejector opening 48 at the diametrically opposite end thereof, similarly enlarged to accommodate a range of sizes of dispensed objects. The screw 45 is adjusted so that the curved forward face 49 of the pusher plate 44 is in contact with the uppermost pill 50. To dispense a pill, it is simply necessary to engage the thumb actuator 51 of the slider 38 with the thumb, slide it forward, whereupon the closure 40 automatically opens while the pusher plate 44 extracts the uppermost pill 50, carrying it through the ejector opening 48 as shown in FIG. 10. Returning the slider to the rear position allows the spring 6 to bias the next pill against the top portion 17 of the inner tube, thus readying the device for another dispensing cycle.

In order to adapt the instrument for dispensing pills of a different size or shape, it is simply necessary to insert an appropriate inner tube (see FIGS. **6*a–e*), and to adjust the screw 45 such that the pusher plate 44** engages only the uppermost pill.

The holder can be used for pills or capsules of various shapes and sizes. For this purpose the same outer tube, various inner tubes may be used with the same outer circumference but different from each other in the shape and size of the inner cross section, which is adapted to the shape and size of the pills and capsules to be used.

In FIGS. **6*a, b, c, d* and *e*, cross sections are illustrated as an example of a group of five different inner tubes, respectively 5*a, b, c, d* and *e*, which can be used with the same outer tube. The inner tubes 5*a, b, c* and *d* carry on their inner wall four ribs, respectively 25*a, b, c* and *d*, which run longitudinally along the total length of the tube, and which are spaced apart a selected distance and protrude radially inwards over a selected distance. The radial projection of these ribs in a given inner tube has been selected to accommodate certain sizes of pills, etc. to be carried. As an example, tube 5*a* is suitable for circular shaped pills, tube 5*b* for oval shaped pills, tube 5*c* for triangular pills and tube 5*d* for capsules. The tube 5*e* has no ribs and is, for example, suitable for circular pills with a relatively large diameter. It goes without saying that one of these illustrated tubes is also suitable for more than one pill shape; for example, tube 5*d* can be used for small round pills, and tube 5*a***, for example, for a large triangular pill or an oval tablet. Other than the illustrated rib sizes are possible to accommodate differently shaped pills or capsules.

The invention described herein is not limited to the illustrated embodiments, but is intended to cover modifications and equivalents which are within the scope of the invention, as described in the claims.

For example, the inner tube can consist of two halves which, along one side have been fixed together with a hinge while having snap fasteners along the other side. Also, the inner diameter of the inner tube can be conformed to the shape of desired objects by means other than the illustrated ribs. For example, the inner tube can have a shape adjusted to the pill to be used and have ribs at the outer circumference to center the inner tube in the outer tube. In this form, the platform for spring 6 in the outer tube would be made exchangeable.

In addition, other means than those described above can be used to fit the inner tube in the correct position into the outer tube.

I claim as my invention:

1. A holder for pills, capsules and similar uniformly shaped objects for dispensing said objects one by one comprising, in combination, a hollow outer tube closed at one end and open at the other, a dispensing mechanism having means for removably securing same to the outer tube over the open end thereof, the outer tube having a spring attached to the closed end which in the relaxed condition extends to the open end, a hollow inner tube for insertion into the outer tube and having a length which when inserted into the outer tube extends over the greater part of the length thereof, the inner tube being completely removable from the outer tube for interchangeability with another said inner tube, the inner tube being sized for insertion into the outer tube through the open end thereof when the dispensing mechanism is removed, the dispensing mechanism when secured to the outer tube cooperating to hold the inner tube in place, means for conforming the inner diameter of the inner tube to the shape of said objects so that a stack of said objects is held within said inner tube, the inner tube being open at one end for receiving the spring and biasing said objects and closed at said other end for limiting axial travel of said objects, the inner tube being slotted at diametrically opposite sides of the periphery of said closed end for allowing entry of a pusher through one said slot and allowing exit of said objects through the opposite slot, said dispensing mechanism having manually operable means connected to said pusher for displacing said pusher in a radial direction to dispense said objects one by one.

2. A holder according to claim 1 wherein the dispensing mechanism comprises a cylindrical casing having means for fixing same to the outer tube, an ejector opening in the periphery of the casing, a lever pivotable on a pivot in the casing, means at one end of the lever for closing the ejector opening in one lever position and opening same in the other lever position, said pusher disposed at the opposite end of the lever, whereby manually pivoting the lever opens the ejector opening and radially displaces the pusher to push the uppermost one of said objects through the ejector opening.

3. A holder according to claim 2 wherein said means for conforming includes a plurality of axially extending ribs on the inner wall of said inner tube spaced to provide guidance surfaces for said objects.

4. A holder according to claim 2 wherein the inner tube comprises two half cylindrical sections and fastener means for joining said sections to form the cylindrical tube.

5. A holder according to claim 4 wherein the fastener means protrude beyond the outer diameter of the inner tube, the outer tube including longitudinal grooves in the inner wall thereof mating said fastener means.

6. A holder according to claim 2 wherein the spring includes a platform at the top thereof for supporting the column of objects in said inner tube.

7. A holder according to claim 1 wherein the dispensing mechanism comprises a cylindrical casing having means for fixing same to the outer tube, an ejector opening in the periphery of the casing, a slider arranged for radial travel in said casing between open and closed positions, closure means connected to the slider for opening and closing the ejector opening in the associated slider positions, and means connecting said pusher to the slider for ejecting the uppermost one of said objects through the ejector opening as said slider is manually moved from the closed to the open position.

8. A holder according to claim 7 wherein said connecting means includes means for adjusting same in the axial direction to conform to objects of different shape.

9. A holder according to claim 7 wherein said closure means is pivotally connected to the slider, and means for pivoting said closure means away from said ejector opening as said slider is moved from the closed to the open position.

10. A holder according to claim 7 wherein said means for conforming includes a plurality of axially extending ribs on the inner wall of said inner tube spaced to provide guidance surfaces for said objects.

* * * * *